US005952992A

United States Patent [19]

Helms

[11] Patent Number: 5,952,992

[45] **Date of Patent: *Sep. 14, 1999**

[54] INTELLIGENT LCD BRIGHTNESS CONTROL SYSTEM

[75] Inventor: Frank P. Helms, Round Rock, Tex.

[73] Assignee: Dell U.S.A., L.P., Round Rock, Tex.

[ * ] Notice: This patent is subject to a terminal disclaimer.

[21] Appl. No.: 08/914,351

[22] Filed: Aug. 19, 1997

Related U.S. Application Data

[63] Continuation of application No. 08/503,346, Jul. 17, 1995, Pat. No. 5,760,760.

[51] Int. Cl.[6] ..... G09G 3/36

[52] U.S. Cl. ..... 345/102; 345/207; 349/61

[58] Field of Search ..... 345/63, 101, 102, 345/211, 207, 199; 348/602; 315/157; 349/61–64

[56] References Cited

U.S. PATENT DOCUMENTS

| | | | |
|---|---|---|---|
| 4,760,389 | 7/1988 | Aoki et al. | 345/102 |
| 5,029,982 | 7/1991 | Nash | 345/101 |
| 5,153,756 | 10/1992 | Ike | 345/87 |
| 5,157,525 | 10/1992 | Eaton et al. | 345/207 |
| 5,270,818 | 12/1993 | Ottenstein | 348/602 |
| 5,406,305 | 4/1995 | Shimomura et al. | 345/102 |
| 5,554,912 | 9/1996 | Thayer et al. | 315/157 |
| 5,760,760 | 6/1998 | Helms | 345/102 |
| 5,818,553 | 10/1998 | Koenck et al. | 349/61 |

*Primary Examiner*—Steven J. Saras
*Assistant Examiner*—Xu-Ming Wu
*Attorney, Agent, or Firm*—Haynes and Boone, LLP

[57] ABSTRACT

Method and apparatus for automatically adjusting the brightness level of an LCD based on the ambient lighting conditions of the environment in which the LCD is being operated are disclosed. In a preferred embodiment, a photodetector located proximate the front of the LCD generates to brightness control circuitry signals indicative of ambient lighting conditions. These signals are correlated to predetermined automatic brightness control values for use in controlling the brightness level of the LCD. Once the ambient light signals have been used automatically to set the brightness level of the LCD, user-selection of a different brightness level, either higher or lower, will override the automatic brightness control setting. In an alternative embodiment, a first photodetector is located proximate the front of the LCD and a second photodetector is located proximate the back of the LCD. In this embodiment, the brighter ambient condition is used to control the brightness level of the LCD.

12 Claims, 2 Drawing Sheets

INTELLIGENT LCD BRIGHTNESS CONTROL SYSTEM

This is a continuation of application(s) Ser. No. 08/503,346 filed on Jul. 17, 1995, now U.S. Pat. No. 5,760,760.

TECHNICAL FIELD

The invention relates generally to liquid crystal displays (LCDs) and, more particularly, to a system for automatically adjusting the brightness of an LCD responsive to the amount of ambient light available during operation thereof.

BACKGROUND OF THE INVENTION

Liquid crystal displays (LCDs) are used in portable personal computers (PCs) and other electronic devices to display information. LCDs modulate light to create images using selectively transmissive and opaque portions of the display, the selection being controlled by passing electrical current through the liquid crystal material. Transmissive-type LCDs are illuminated by an artificial backlight positioned behind the LCD glass to provide the contrast between the light transmissive and opaque portions of the display.

The LCD backlight is one of the primary sources of power consumption in a portable PC and the power consumed by the backlight is directly related to the brightness level selected. Therefore, it would be advantageous, from a power consumption standpoint, to operate the PC with the LCD at the lowest possible brightness level at which the contents of the display can still be seen by the user. For example, in a particular portable PC model available from Dell Computer Corporation of Austin, Tex., operating the PC with the LCD set to the minimum brightness level, as compared to the maximum brightness level, can reduce overall power consumption of the PC by approximately twenty percent (20%), which in turn increases the runtime of the PC between battery charges by the same percentage. Specifically, assuming that in the example just described the PC has a typical runtime between battery charges of 8 hours with the LCD set to the maximum brightness level, decreasing the brightness level to the minimum level will increase the runtime of the PC to 9.6 hours.

In view of the foregoing, it is apparent that a user could significantly increase the runtime between battery charges of his or her portable PC by taking advantage of ambient lighting conditions that increase the visibility of the LCD, that is, low ambient light, and decreasing the brightness level of the LCD whenever the PC is being operated in such lighting conditions. Specifically, it is obvious that the contents of an LCD can be much more easily viewed in a dark room than a bright one. Hence, a user could take advantage of that fact by decreasing the brightness level of the LCD whenever ambient lighting conditions permit and then subsequently increasing the brightness level only when necessitated by bright ambient lighting conditions.

While foregoing manual brightness adjustment presents a viable option for increasing the runtime of a PC between charges, it is deficient in certain respects. In particular, while a user may begin by operating the PC with the LCD brightness set to the minimum level necessary to enable the contents of the display to be perceived, after a user has moved with the PC to an environment in which the ambient lighting conditions require that the LCD be set to the maximum brightness level, the user will typically forget to decrease the brightness level upon returning to an environment in which the ambient lighting conditions would be conducive to such a decrease. As a result, the power savings are not as substantial as might be the case were the brightness adjustment to occur automatically.

Accordingly, what is needed is an intelligent LCD brightness control system which automatically adjusts to the ambient lighting conditions of the environment in which the PC is being used.

SUMMARY OF THE INVENTION

The foregoing problems are solved and a technical advance is achieved by method and apparatus for automatically adjusting the brightness level of an LCD based on the ambient lighting conditions of the environment in which the LCD is being operated. In a departure from the art, a photodetector located proximate the front of the LCD generates to brightness control circuitry signals indicative of ambient lighting conditions. These signals are correlated to automatic brightness control values for use in controlling the output of a backlight driver circuit that determines the brightness level of the LCD.

In one embodiment of the present invention, signals indicative of a user selected brightness level are also input to the brightness control circuitry and taken into account in to the adjustment of the brightness level of the LCD. In one aspect of the invention, once the ambient signals have been used automatically to set the brightness level of the LCD, subsequent user-selection of a different brightness level, either higher or lower, will override the automatic brightness control setting.

In an alternative embodiment, a first photodetector is located proximate the front of the LCD and a second photodetector is located proximate the back of the LCD. In this embodiment, the brighter ambient condition is used to control the brightness level of the LCD. This embodiment is especially useful in situations in which light is directed toward the back of the LCD, and hence toward the user's eyes, which light, while affecting the visibility of the LCD, might not be detected by the first photodetector.

A technical advantage achieved with the invention is that it provides increased run-time between battery charges by lowering the brightness level of an LCD during use in low ambient lighting conditions.

Another technical advantage achieved with the invention is that the adjustment of the brightness level occurs automatically without user intervention, thereby reducing the possibility that a user may set the brightness level at a maximum level during use in high ambient lighting conditions and subsequently neglect to lower the level upon returning to a low ambient lighting condition.

Yet another technical advantage achieved with the invention is that, in at least one embodiment, the user may override the automatic brightness control setting using a conventional brightness control knob.

DETAILED DESCRIPTION OF THE PREFERRED EMBODIMENT

Figure 1:
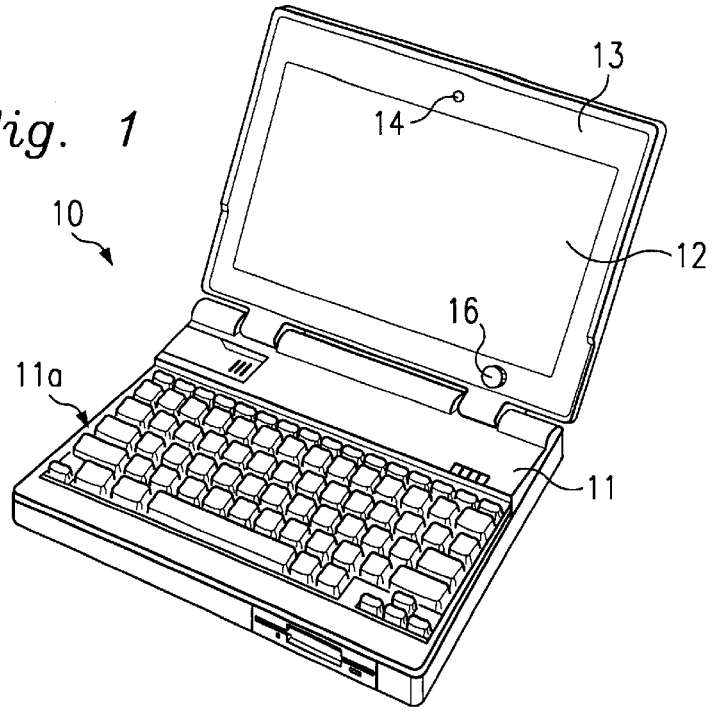
FIG. 1 is a front perspective view of a portable personal computer (PC) embodying features of the present invention.

FIG. 1 illustrates a portable personal computer (PC) 10 embodying features of the present invention and comprising a base 11 including a keyboard 11*a*, a liquid crystal display panel (LCD) 12 disposed in a lid portion 13 of the PC 10, and at least one photodetector or light sensor 14 disposed on the same side of the lid portion 13 proximate the LCD 12, for detecting a level of ambient light directed toward the front of the LCD 12 and for generating signals indicative of same. A brightness control knob 16 is also conveniently located proximate the LCD 12 for enabling the user manually to adjust the brightness level of the LCD 12.

Figure 2:
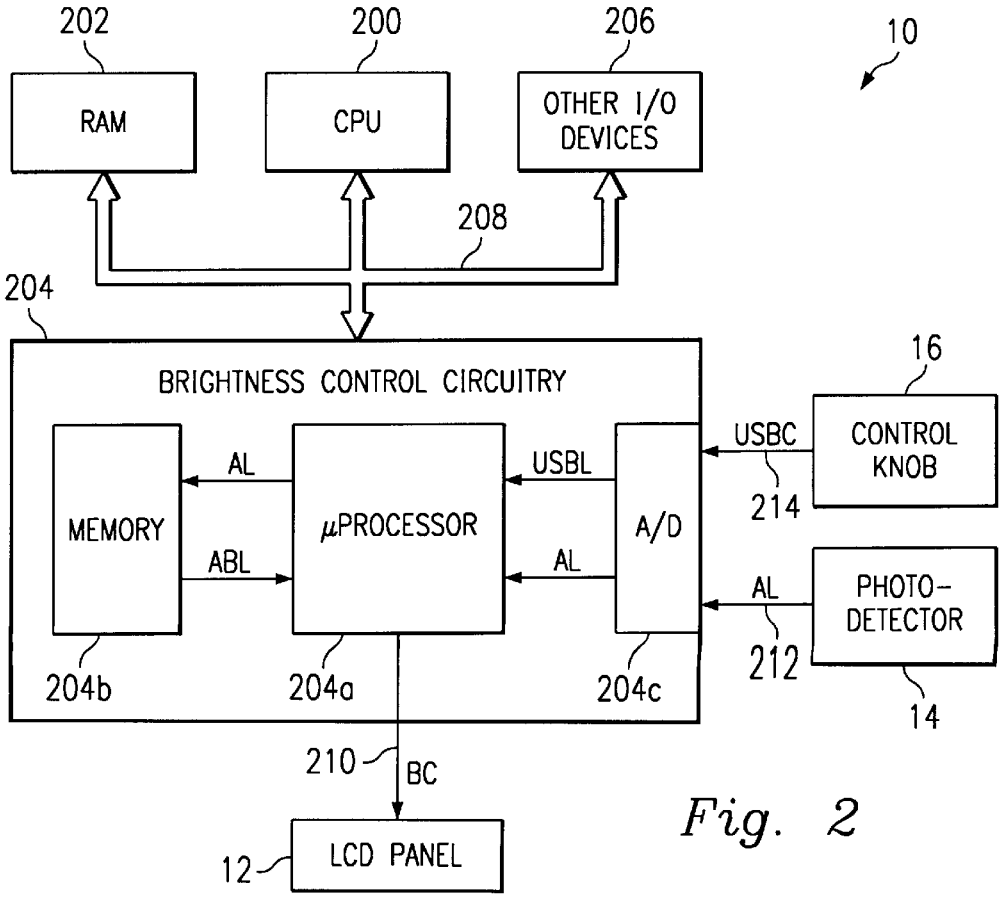
FIG. 2 is a system block diagram of the portable PC of FIG. 2.

FIG. 2 is a system block diagram of the PC 10 of FIG. 1. As shown in FIG. 2, the PC comprises a CPU 200, system RAM 202, brightness control circuitry 204, and other I/0 devices 206, including the keyboard 11*a* (FIG. 1), electrically interconnected via a bus 208. In the preferred embodiment, the brightness control circuitry comprises a microprocessor 204*a*, memory 204*b*, and an analog-to-digital ("A/D") converter 204*c* for purposes that will subsequently be described in detail.

An output of the microprocessor 204*a* is electrically connected to backlight driver circuitry ("BDC") which, although not explicitly shown, forms a portion of the LCD 12 in a conventional manner for generating brightness control, or "BC," signals thereto via a line 210 for controlling the brightness level of the LCD 12 at any given time. In addition, analog signals generated by the photodetector 14 indicative of the level of ambient light striking the front of the LCD 12 (hereinafter "ambient light" or "AL" signals), as well as analog control signals indicative of the brightness level selected by the user via the control knob 16 (hereinafter "user-selected brightness level" or "USBL" signals), are input to the brightness control circuitry 204 on lines 212, 214, respectively. The analog AL and USBL signals are converted to digital signals by the analog-to-digital converter 204*c* and then input to the microprocessor 204*a*.

A plurality of automatic brightness level ("ABL") signal values, each of which corresponds to a particular one of a plurality of various possible AL signal values, are stored in the memory 204*b*. It will be understood that the ABL signal value associated with each of the AL signal values will be determined empirically and will depend, at least partially, on the relevant parameters of the particular LCD 12, as well as a subjective determination of the optimum LCD brightness level for operation in the given ambient lighting condition. In one embodiment, the ABL signal values are stored in the memory 204*b* as a lookup table indexed by the input AL signal value, such that input of an AL signal thereto via the microprocessor 204*a* results in the output therefrom of the corresponding ABL signal, although various other manners of implementation are anticipated. In any event, once the microprocessor 204*a* accesses from the memory 204*b* the ABL signal value corresponding to the AL signal input thereto, it outputs to the LCD 12 an appropriate BC signal for adjusting the brightness level of the BDC of the LCD 12 in accordance with the levels indicated by the USBL and AL signals, as will be described in detail with reference to FIG. 3.

Figure 3:
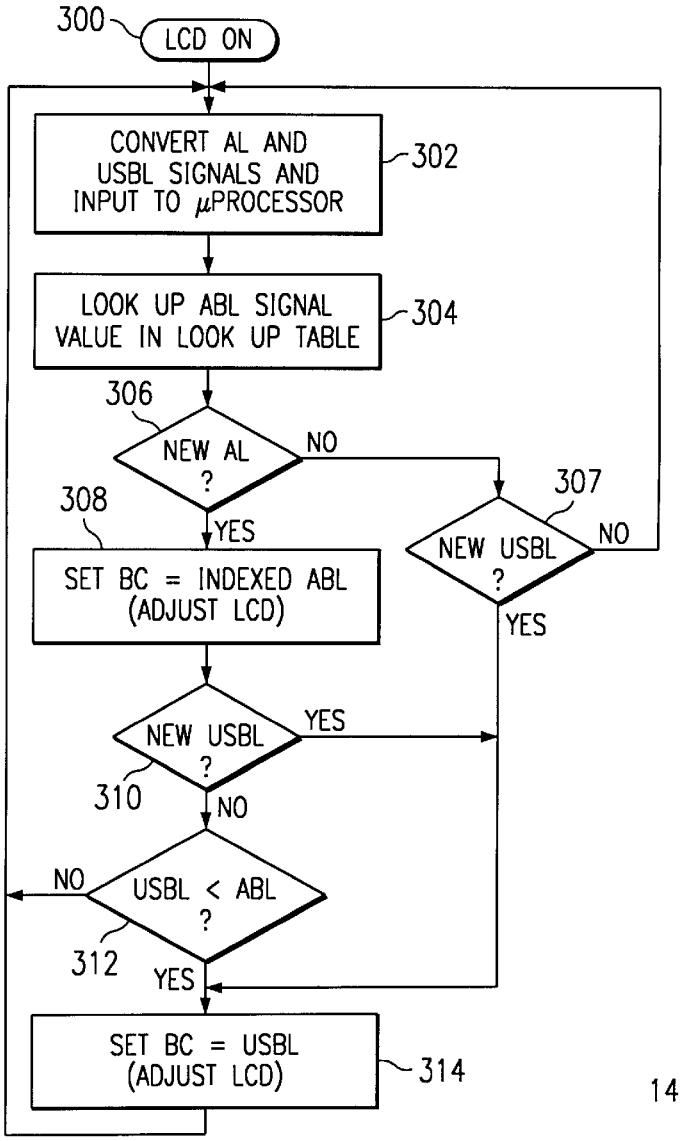
FIG. 3 is a flowchart of the operation of brightness control circuitry for implementing the method of the present invention.

FIG. 3 is a flowchart of the operation of the brightness control circuitry 204 for implementing the preferred embodiment of the present invention. It should be understood that instructions for execution by the microprocessor 204*a* for implementing the invention are preferably stored in memory 204*b*. Execution starts in step 300 when the LCD 12 is turned on. In step 302, the analog AL and USBL signals respectively generated by the photodetector 14 and control knob 16 and input to the brightness control circuitry 204 are converted to digital signals by the A/D converter 204*c* and then input to the microprocessor 204*a*. In step 304, the digital AL signal is used to index the ABL signal lookup table (not shown) stored in the memory 204*b*. In step 306, a determination is made whether the AL signal has changed, indicating that the ambient lighting conditions have changed. If not, indicating that no adjustment for ambient lighting conditions is necessary, execution proceeds to step 307. In step 307, a determination is made whether the USBL signal has changed, indicating that the user has readjusted the control knob 16 to manually change the brightness level of the LCD 12. If the USBL signal has not changed, execution returns to step 302.

If in step 306, the ABL signal has changed, execution proceeds to step 308, in which the BC signal output to the LCD 12 for controlling the brightness level of the LCD 12 is set to correspond to the ABL signal indexed by the AL signal, thereby adjusting the brightness level of the LCD 12 according to the current ambient lighting conditions. In step 310, a determination is again made whether the USBL signal has changed. If not, execution proceeds to step 312, in which a determination is made whether the value of the USBL signal is less than the indexed ABL value, indicating that the user has manually selected, using the control knob 16, a brightness level lower than that automatically selected in view of the current ambient lighting conditions. If the value of the USBL signal is more than the indexed ABL value, execution returns to step 302; otherwise, execution proceeds to step 314, in which the BC signal output to the BDC of the LCD 12 is set to correspond to the USBL signal. Similarly, if in steps 307 or 310, the USBL signal has changed, execution proceeds directly to step 314. Once the brightness of the LCD 12 has been set to the level indicated by the USBL signal in step 314, execution returns to step 302.

In this manner, the brightness control circuitry 204 ensures that the brightness level of the LCD 12 is always set to the lower of the level indicated by the ABL signal or USBL signal, unless the user selects a different brightness level, using the control knob 16, subsequent to a change in the ambient lighting conditions in which the LCD 12 is being used. In the latter case, the USBL signal is used to control the brightness level of the LCD 12.

Figure 4:
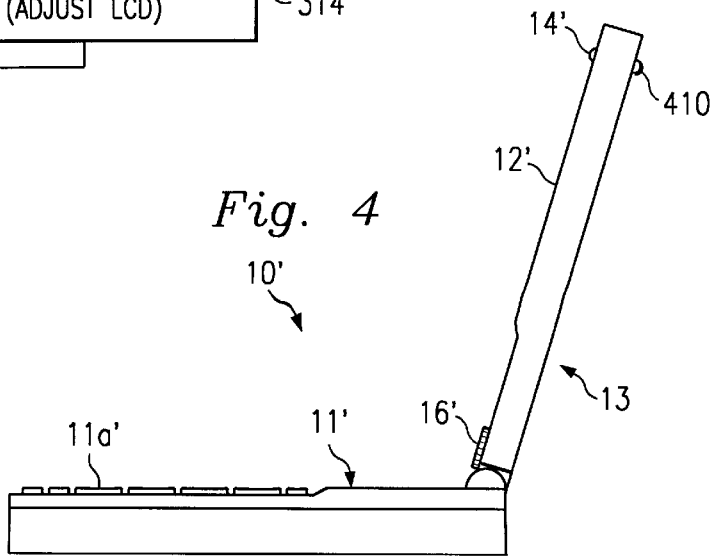
FIG. 4 is a rear perspective view of a portable PC embodying features of an alternative embodiment of the present invention.

FIG. 4 is a rear perspective view of a portable PC 10' embodying features of an alternative embodiment of the present invention. In particular, in addition to comprising all of the same features of the PC 10 shown in FIG. 1, including a base 11', a keyboard 11*a*', an LCD 12' disposed in a lid 13', a first photodetector 14' and a control knob 16', the PC 10' further comprises a second photodetector 400 disposed on the opposite side of the lid 13' as the LCD 12' and first photodetector 14', for detecting ambient light directed toward the back side of the LCD 12' and toward a user's eyes.

In the alternative embodiment, the greater of an AL signal generated by the photodetector 14' and an AL signal generated by the 410 is used to index the lookup table comprising ABL signal values, as described with reference to FIGS. 2 and 3. In this manner, the brighter ambient lighting condition is used to determine the ABL signal value for use in adjusting the brightness level of the LCD 12'. It will be apparent that, with this alternative embodiment, the user is insured that the contents of the LCD 12' will be visible where, for example, the area behind the LCD 12' is highly illuminated, but the area in front of the LCD 12' is not. This might not be the case absent the second photodetector 410 as shown in FIG. 4, the brightness level of the LCD 12' would most likely be set too low for the user comfortably to view the contents thereof. Alternatively, a weighted average of the AL signals generated by the photodetectors 14' and

410, as computed by the microprocessor 402*a*, could be used to index the lookup table.

It is understood that the present invention can take many forms and embodiments. The embodiments shown herein are intended to illustrate rather than to limit the invention, it being appreciated that variations may be made without departing from the spirit or the scope of the invention. For example, the LCD brightness control circuitry 204 could comprise some sort of artificial intelligence, i.e., a neural network, for "learning" the user's preferred brightness settings in various ambient lighting conditions, as indicated by the control knob setting, such that when the settings are later re-encountered, the LCD 12 will be automatically adjusted to the user's preferred brightness setting. Alternatively, the brightness control circuitry 204 could be simplified to provide a direct linear control signal of measured light to LCD brightness level, thus eliminating the need for the A/D converter 204*c* and microprocessor 204*a*.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. In an electronic device having a liquid crystal display (LCD), an apparatus for automatically adjusting the brightness of the LCD in response to ambient lighting conditions, the apparatus comprising:

a brightness control circuitry including a microprocessor and a memory;

means for manually adjusting the brightness of the LCD and generating a selected brightness level signal to the microprocessor;

a first photodetector for detecting a level of ambient light directed toward a first side of the LCD and for generating a first ambient light signal to the microprocessor;

a second photodetector for detecting a level of ambient light directed toward a second side of the LCD opposite said first side of the LCD and for generating a second ambient light signal to the microprocessor;

means for converting the first and second ambient light signals for input into the microprocessor;

the memory having automatic brightness level signals indexed by the first and second ambient light signals;

means for selecting one of said automatic brightness level signals using said first and second ambient light signals;

means for determining the lower value of the selected brightness level signal and the selected automatic brightness level signal; and means for setting the brightness level of the LCD to correspond to either the selected brightness level signal if the user has manually adjusted after the automatic brightness level signals have been indexed, or the lower value of the selected brightness level signal and the selected automatic brightness level signal.

2. The apparatus of claim 1 wherein said means for selecting comprises means for selecting the lower value of the automatic brightness level signal indexed by said first ambient light signal and the automatic brightness level signal indexed by said second ambient light signal.

3. The apparatus of claim 2 wherein said means for selecting comprises means for selecting an average of said automatic brightness level signals indexed.

4. The apparatus of claim 1 wherein said first side is a front side of said LCD.

5. The apparatus of claim 1 wherein said second side is a back side of said LCD.

6. In an electronic device having a liquid crystal display (LCD), an apparatus for automatically adjusting the brightness of the LCD in response to ambient lighting conditions, the apparatus comprising:

brightness control circuitry including a microprocessor and a memory;

means for manually adjusting the brightness of the LCD and generating a user-selected brightness level signal to the microprocessor;

at least two photodetectors for detecting at least two levels of ambient light directed toward a front side and a back side of the LCD and for generating at least two ambient light signals to the microprocessor, wherein one of the at least two signals corresponds to the front side of the LCD and another of the at least two signals corresponds to the back side of the LCD;

means for converting the at least two ambient light signals for input into the microprocessor;

the brightness control circuitry further comprising artificial intelligence for learning over time user preferences with respect to said LCD brightness level in certain ambient lighting conditions as indicated by respective user-selected brightness level signals generated in response thereto, wherein the brightness control circuitry sets the LCD brightness level to a brightness level corresponding to a preferred LCD brightness level associated with said at least two ambient light signals, said preferred LCD brightness level not necessarily corresponding to a current user-selected brightness level signal.

7. In an electronic device having a liquid crystal display (LCD), a method of automatically adjusting the brightness of the LCD in response to ambient lighting conditions, the method comprising the steps of:

manually adjusting the brightness level of the LCD and generating a selected brightness level signal to a microprocessor;

detecting a level of ambient light directed toward a first side of the LCD and for generating a first ambient light signal to the microprocessor;

detecting a level of ambient light directed toward a second side of the LCD opposite said first side of the LCD and for generating a second ambient light signal to the microprocessor;

storing in a memory automatic brightness level signals indexed by the first and second ambient light signals;

selecting one of automatic brightness level signals using said first and second ambient light signals;

determining the lower value of the selected brightness level signal and the selected automatic brightness level signal; and setting the brightness level of the LCD to correspond to either the selected brightness level signal if the user has manually adjusted after the automatic brightness level signals have been indexed, or the lower value of the selected brightness level signal and the selected automatic brightness level signal.

8. The method of claim 7 wherein said step of selecting comprises a step of selecting the lower value of the automatic brightness level signal indexed by said first ambient light signal and the automatic brightness level signal indexed by said second ambient light signal.

9. The method of claim 7 wherein said step of selecting comprises a step of selecting an average of the automatic brightness level signals indexed by said first and second ambient light signals.

10. The method of claim 7 wherein said first side is a front side of said LCD.

11. The method of claim 7 wherein said second side is a rear side of said LCD.

12. In an electronic device having a liquid crystal display (LCD) and a microprocessor, a method of automatically adjusting the brightness of the LCD in response to ambient lighting conditions, the method comprising the steps of:

detecting at least two levels of ambient light directed toward a front side and a back side of the LCD and for generating at least two ambient light signals to the microprocessor, wherein one of the at least two ambient light signals corresponds to the front side of the LCD and another of the at least two ambient light signals corresponds to the back side of the LCD;

converting the at least two ambient light signals for input into the microprocessor;

detecting a user-selected brightness level signal generated to the microprocessor;

learning over time user preferences with respect to said LCD brightness level in certain ambient lighting conditions as indicated by respective user-selected brightness level signals generated in response thereto; and setting the LCD brightness level to a brightness level corresponding to a preferred LCD brightness level associated with said at least two ambient light signals, said preferred LCD brightness level not necessarily corresponding to a current userselected brightness level signal.

* * * * *